US011743655B2

(12) United States Patent
Yokoi et al.

(10) Patent No.: US 11,743,655 B2
(45) Date of Patent: Aug. 29, 2023

(54) PIEZOELECTRIC SOUND-GENERATING COMPONENT CASE AND PIEZOELECTRIC SOUND-GENERATING COMPONENT

(71) Applicant: Murata Manufacturing Co., Ltd., Nagaokakyo (JP)

(72) Inventors: Yuko Yokoi, Nagaokakyo (JP); Tadashi Okuzawa, Nagaokakyo (JP); Koji Yasojima, Nagaokakyo (JP); Ryuuji Morishita, Nagaokakyo (JP)

(73) Assignee: MURATA MANUFACTURING CO., LTD., Nagaokakyo (JP)

( * ) Notice: Subject to any disclaimer, the term of this patent is extended or adjusted under 35 U.S.C. 154(b) by 59 days.

(21) Appl. No.: 17/590,554

(22) Filed: Feb. 1, 2022

(65) Prior Publication Data

US 2022/0159385 A1 May 19, 2022

Related U.S. Application Data

(63) Continuation of application No. PCT/JP2020/019186, filed on May 14, 2020.

(30) Foreign Application Priority Data

Sep. 20, 2019 (JP) ..... 2019-171545

(51) Int. Cl.
*H04R 25/00* (2006.01)
*H04R 17/00* (2006.01)

(52) U.S. Cl.
CPC ..... *H04R 17/00* (2013.01)

(58) Field of Classification Search
CPC ..... H04R 31/006; H04R 1/02; H04R 17/00; H04R 17/02; H04R 17/10; H04R 9/047; H04R 9/025; H04R 7/18
See application file for complete search history.

(56) References Cited

U.S. PATENT DOCUMENTS

2006/0193107 A1* 8/2006 Kami ..... H04R 17/00 361/600
2016/0338669 A1 11/2016 Naka

FOREIGN PATENT DOCUMENTS

JP H1034982 A 2/1998
JP 3966352 B2 8/2007
WO 2015174452 A1 11/2015

OTHER PUBLICATIONS

International Search Report issued for PCT/JP2020/019186, dated Aug. 4, 2020.

* cited by examiner

*Primary Examiner* — Amir H Etesam
(74) *Attorney, Agent, or Firm* — ArentFox Schiff LLP

(57) ABSTRACT

A piezoelectric sound-generating component case that includes a case body for housing a vibrating plate and insert terminals that are provided in the case body for applying a voltage to the vibrating plate. The case body includes a bottom or base and a side wall that projects from the peripheral edge of the bottom. The case body is provided with an opening that opens on the leading end side, in the projection direction, of the side wall. The side wall has thick parts at least on the sides where the insert terminals are provided. In a plan view of the case body, the transverse direction width of the thick parts of the side wall is larger than the transverse direction width of the parts of the side wall that are adjacent to the thick parts.

19 Claims, 15 Drawing Sheets

FIG. 10A

| SOUND PRESSURE (dB) | DISTRIBUTION NUMBER | (pcs) |
|---|---|---|
| | PIEZOELECTRIC SOUND-GENERATING COMPONENT 1 OF THIS EMBODIMENT | PIEZOELECTRIC SOUND-GENERATING COMPONENT OF COMPARATIVE EXAMPLE |
| 70.0 | 0 | 0 |
| 70.5 | 0 | 0 |
| 71.0 | 0 | 0 |
| 71.5 | 0 | 0 |
| 72.0 | 0 | 1 |
| 72.5 | 0 | 1 |
| 73.0 | 0 | 0 |
| 73.5 | 0 | 1 |
| 74.0 | 0 | 1 |
| 74.5 | 0 | 1 |
| 75.0 | 0 | 3 |
| 75.5 | 1 | 5 |
| 76.0 | 3 | 8 |
| 76.5 | 8 | 5 |
| 77.0 | 13 | 3 |
| 77.5 | 4 | 1 |
| 78.0 | 1 | 0 |
| 78.5 | 0 | 0 |
| 79.0 | 0 | 0 |
| 79.5 | 0 | 0 |
| 80.0 | 0 | 0 |
| TOTAL | 30 | 30 |

PIEZOELECTRIC SOUND-GENERATING COMPONENT CASE AND PIEZOELECTRIC SOUND-GENERATING COMPONENT

CROSS REFERENCE TO RELATED APPLICATIONS

The present application is a continuation of PCT/JP2020/019186 filed May 14, 2020, which claims priority to Japanese Patent Application No. 2019-171545, filed Sep. 20, 2019, the entire contents of each of which are incorporated herein by reference.

TECHNICAL FIELD

The present invention relates to a piezoelectric sound-generating component case and a piezoelectric sound-generating component.

BACKGROUND

In recent years, piezoelectric sound-generating components, such as piezoelectric sounders and piezoelectric receivers, that generate warning sounds and operation sounds have been widely used in electronic apparatuses, home appliances, mobile phones, and so on. In addition, these piezoelectric sound-generating components simultaneously house and support a vibrating plate and supply a voltage that causes the vibrating plate to undergo bending vibration by employing a case having insert terminals.

For example, Japanese Patent No. 3966352 (hereinafter "Patent Document 1") discloses a case having insert terminals. The case has a bottom wall and four side walls, and has an opening in an upper surface thereof. A terminal formed of a plate-shaped metal plate is vertically fixed to at least one of the side walls by insert molding. A concave groove extending vertically downward is formed on the outer surface of the side wall to which the terminal is fixed. Part of the outer surface of the terminal is exposed in the concave groove. Part of the inner surface, which is on the opposite side from the outer surface, of the terminal exposed in the groove is exposed to the inner surface of the side wall.

Here, in a case for a piezoelectric sound-generating component having an insert terminal provided on a side wall part of the case, such as that disclosed in Patent Document 1, it is desirable to suppress or prevent the occurrence of weak points of strength called weld lines. If weld lines occur, the durability of the case may be degraded and variations in the sound pressure distribution of the piezoelectric sound-generating component may occur.

SUMMARY OF THE INVENTION

Accordingly, it is an object of the present invention to provide a piezoelectric sound-generating component case and a piezoelectric sound-generating component with a reduction in size and that secures the size of a resonance space, and that obtains high reliability by realizing an improvement in strength.

In an exemplary aspect, a case for a piezoelectric sound-generating component is provided that includes a case body for housing a vibrating plate that vibrates when a voltage is applied thereto and an insert terminal that is provided on or in the case body and is for applying a voltage to the vibrating plate. The case body includes a bottom part and a side wall part that projects from a peripheral edge of the bottom part. The case body is provided with an opening that opens on a leading end side of the side wall part in a projection direction of the side wall part. The side wall part has a thick part on at least a side where the insert terminal is provided. In a plan view of the case body, a width in a transverse direction of the thick part of the side wall part is larger than a width in the transverse direction of a part of the side wall part adjacent to the thick part.

According to the present invention, a piezoelectric sound-generating component case and a piezoelectric sound-generating component are provided with a reduction in size and that secures the size of a resonance space, and that also obtains high reliability by realizing an improvement in strength.

BRIEF DESCRIPTION OF DRAWINGS

FIG. 10A is a table comparing the sound pressure distributions of the piezoelectric sound-generating component according to the exemplary embodiment and the piezoelectric sound-generating component according to the comparative example.

DETAILED DESCRIPTION OF EMBODIMENTS

Hereafter, exemplary embodiments of the present invention will be described. In the following description of the drawings, identical or similar constituent elements are denoted by identical or similar reference symbols. The drawings are representative, the dimensions and shapes of the individual parts are schematically illustrated, and the technical scope of the invention of the present application should not be interpreted as being limited to that of the embodiments.

Exemplary Embodiments

<Piezoelectric Sound-Generating Component 1>

Figure 1:
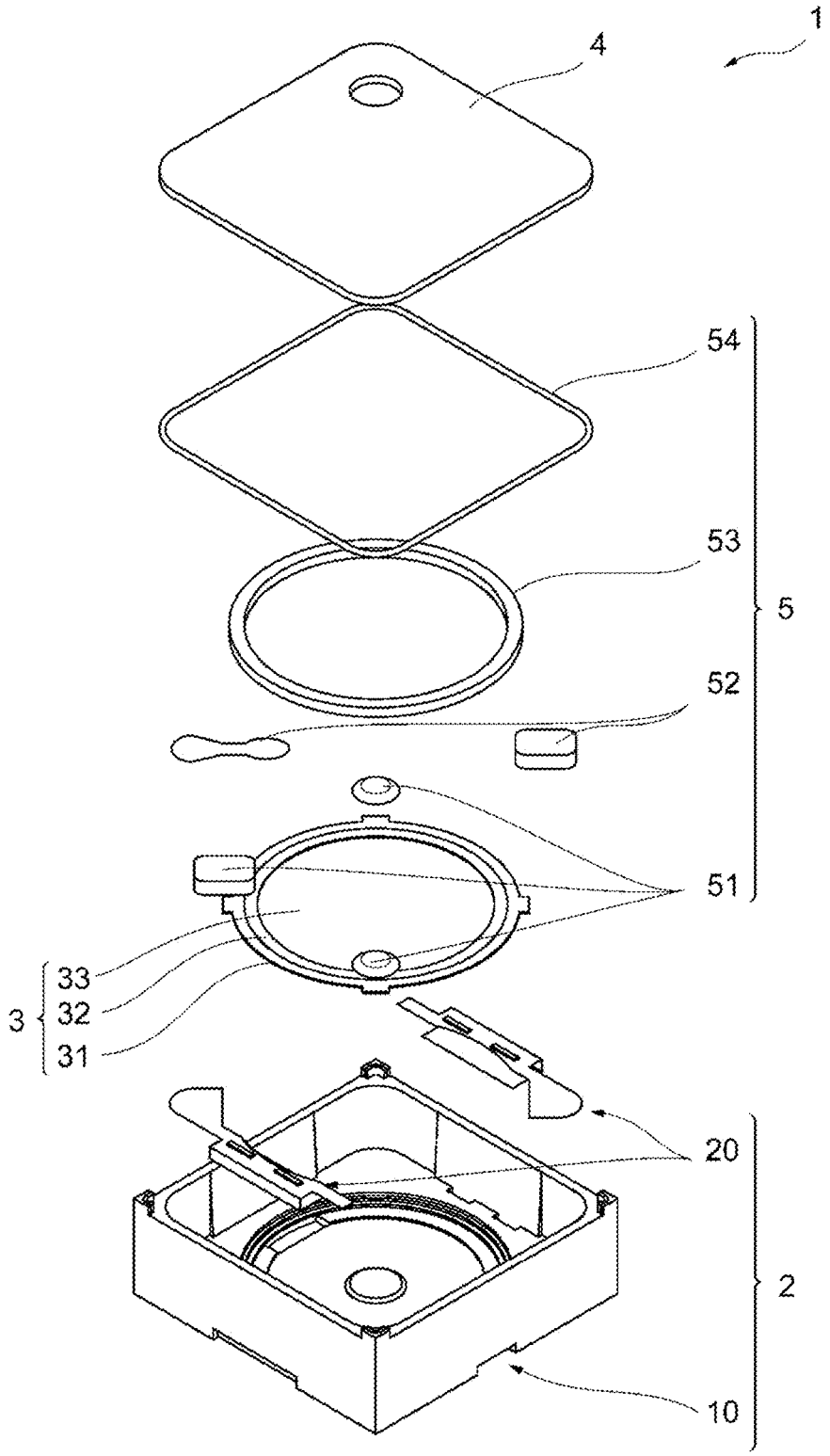
FIG. 1 is an exploded perspective view for describing the configuration of a piezoelectric sound-generating component according to an exemplary embodiment.
Figure 2:
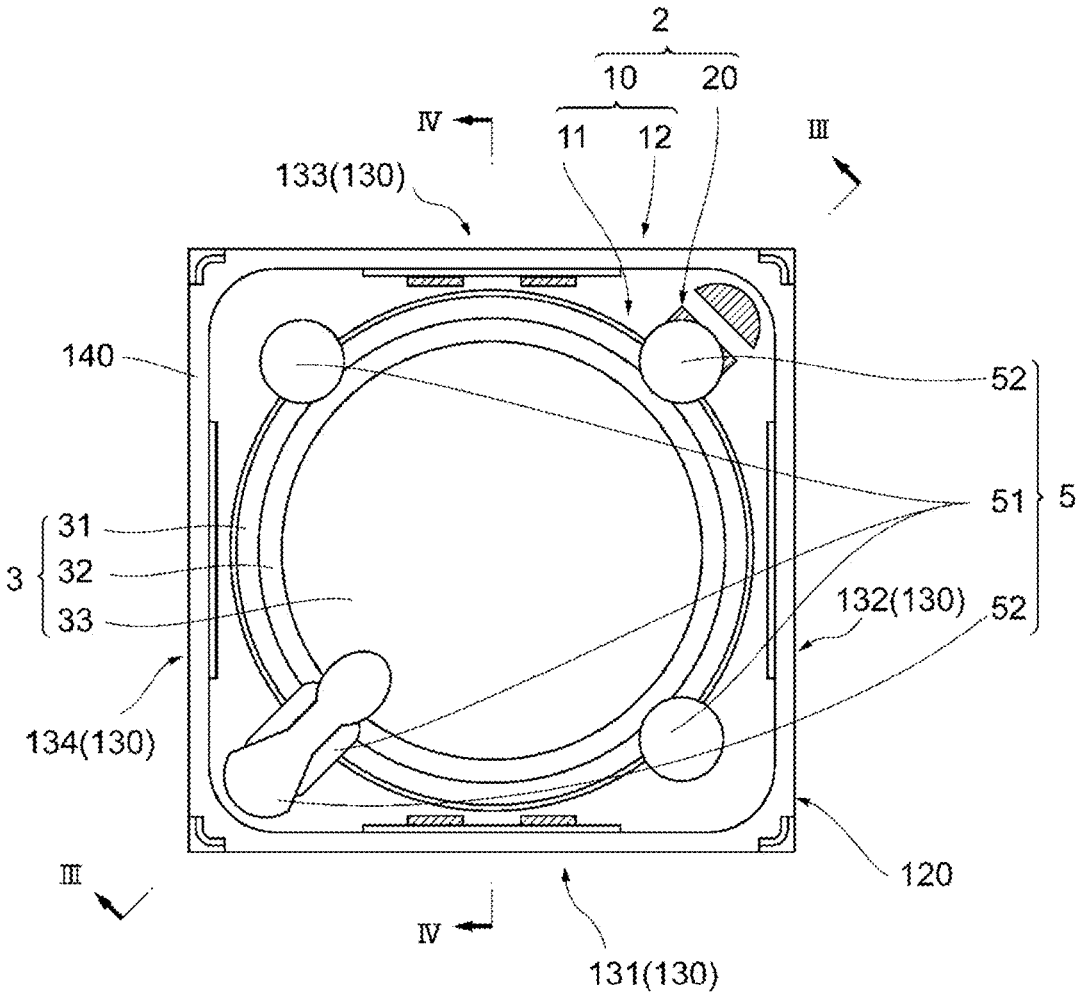
FIG. 2 is a plan view for describing the configuration of the piezoelectric sound-generating component according to the exemplary embodiment.
Figure 3:
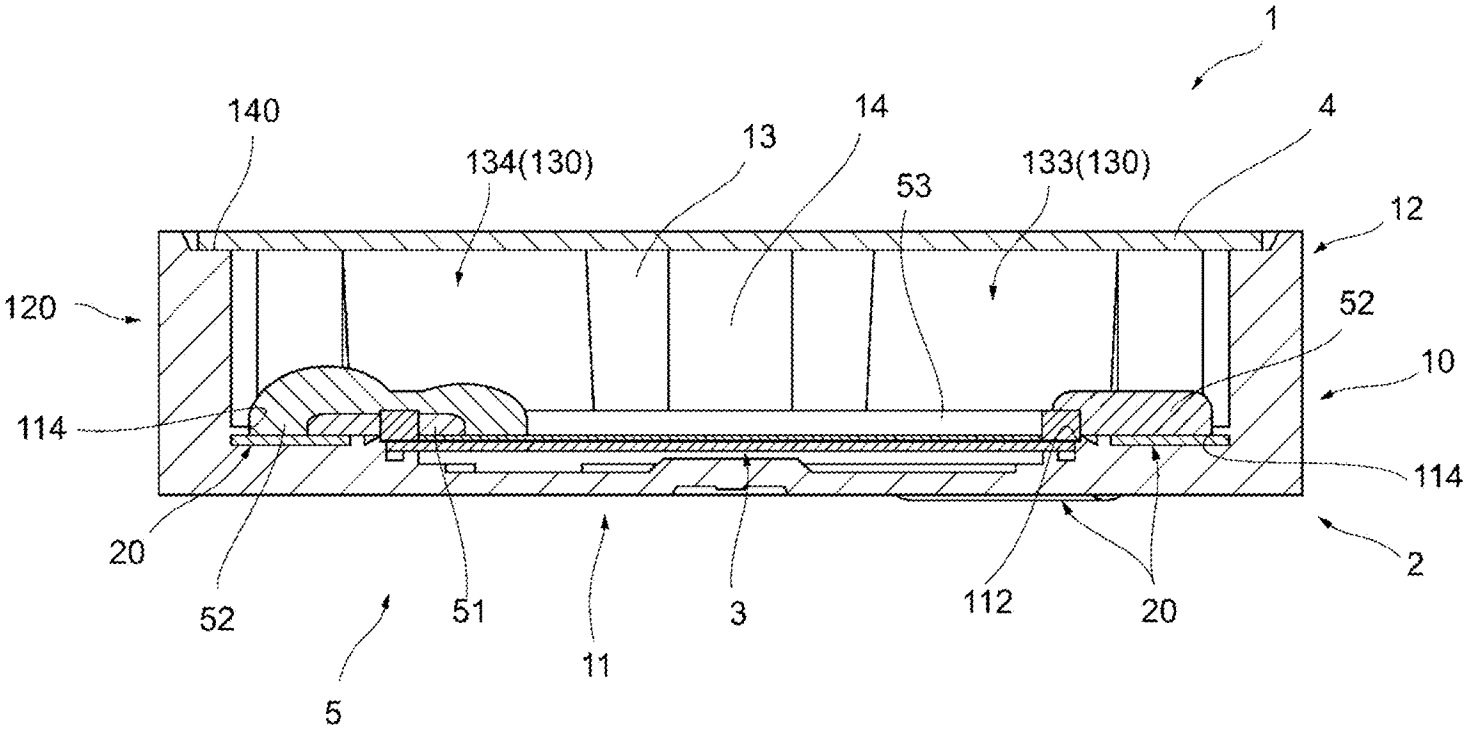
FIG. 3 is a sectional view taken along line III-III in FIG. 2.
Figure 4:
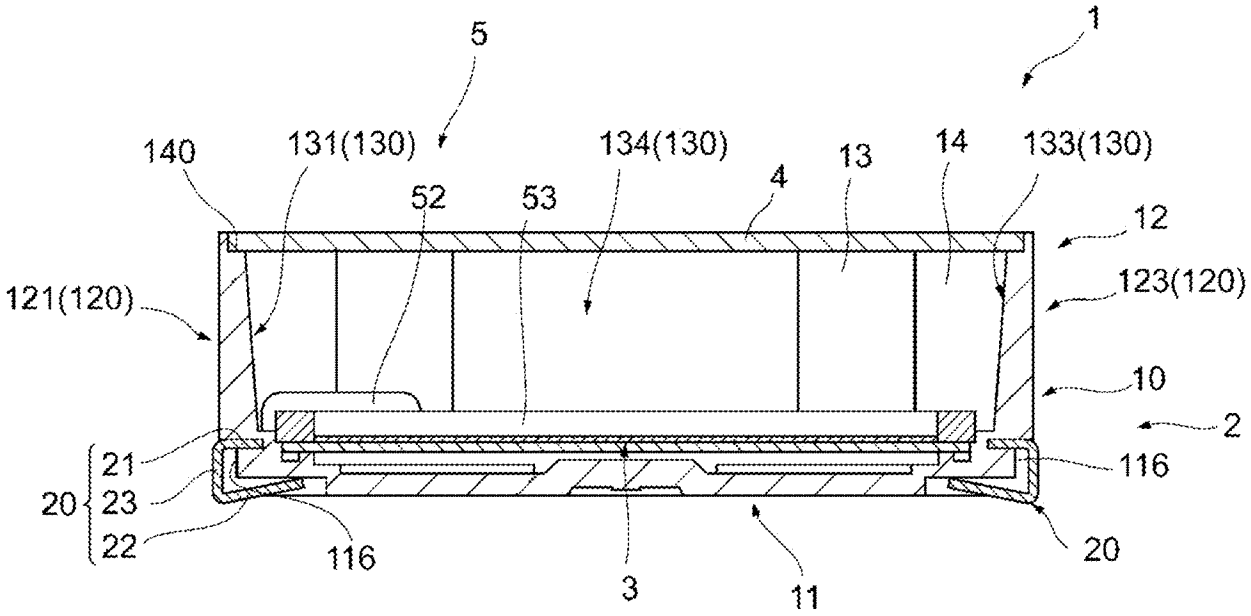
FIG. 4 is a sectional view taken along line IV-IV in FIG. 2.
Figure 5:
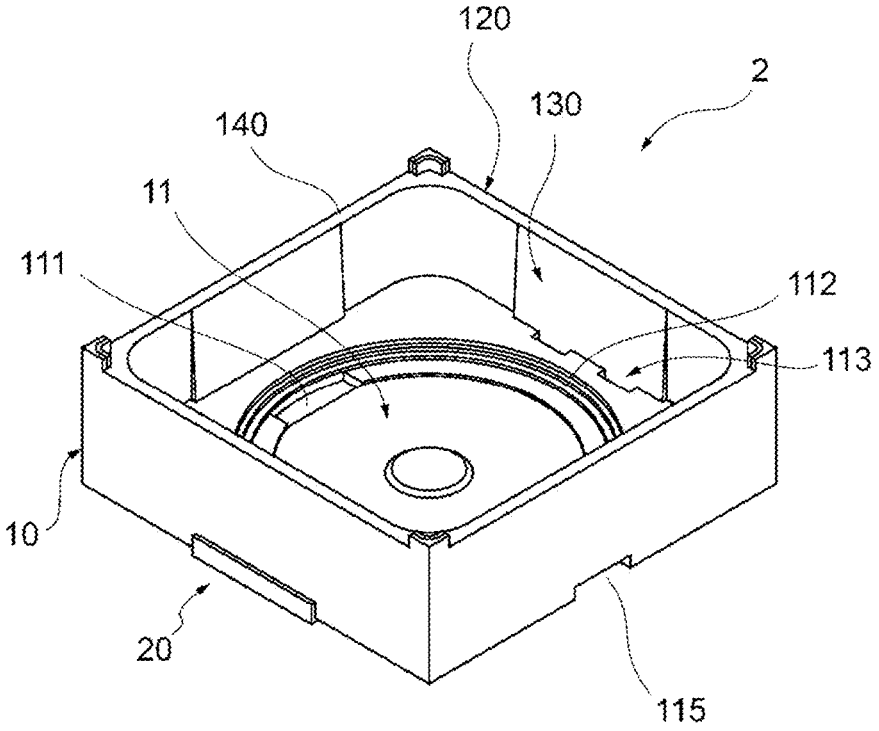
FIG. 5 is a perspective view for describing the configuration of a piezoelectric sound-generating component case according to the exemplary embodiment.
Figure 6:
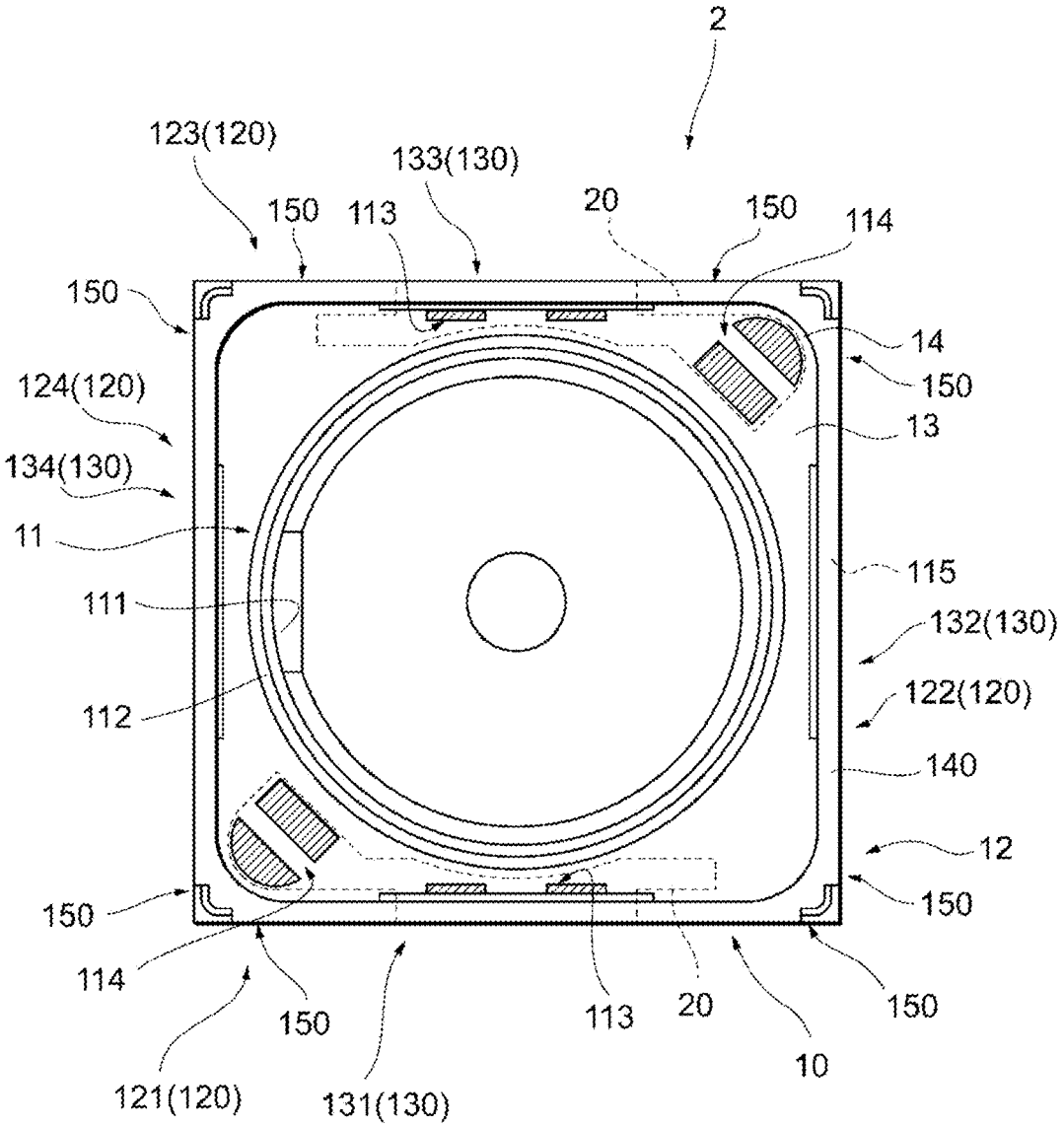
FIG. 6 is a plan view for describing the configuration of a piezoelectric sound-generating component case according to the exemplary embodiment.

First, the configuration of a piezoelectric sound-generating component 1 according to an exemplary embodiment will be described while referring to FIGS. 1 to 6. FIG. 1 is an exploded perspective view for describing the configuration of the piezoelectric sound-generating component 1 according to the embodiment. FIG. 2 is a plan view for describing the configuration of the piezoelectric sound-generating component 1 according to the embodiment. FIG. 3 is a sectional view taken along line III-III in FIG. 2. FIG. 4 is a sectional view taken along line IV-IV in FIG. 2. FIG. 5 is a perspective view for describing the configuration of a case 2 for a piezoelectric sound-generating component case according to the embodiment. FIG. 6 is a plan view for describing the configuration of the case 2 for a piezoelectric sound-generating component according to the embodiment.

In FIGS. 1 to 6, the constituent elements provided for describing at least some of the features in the structure of the piezoelectric sound-generating component 1 have been extracted and illustrated. However, it is noted that this description does not preclude the piezoelectric sound-generating component 1 from having additional elements not illustrated in the figures. In addition, illustration of a cover 4, which is described later, is omitted from FIG. 2. Illustration of electrodes 33, which are described later, is omitted from FIGS. 3 and 4.

The piezoelectric sound-generating component 1 according to this embodiment includes the case 2, a vibrating plate 3, and the cover 4. The case 2 and the cover 4 form an enclosure that houses the vibrating plate 3. The piezoelectric sound-generating component 1 further includes an adhesive 5 that is configured for adhering the vibrating plate 3 and the cover 4 to the case 2.

The vibrating plate 3 includes a metal plate 31, a piezoelectric body 32, and two electrodes 33.

The metal plate 31, the piezoelectric body 32, and the electrodes 33 are all circular plate-shaped members as shown in FIG. 2, for example. The diameter of the metal plate 31 is larger than the diameters of the piezoelectric body 32 and the electrodes 33 and the diameter of the piezoelectric body 32 is larger than the diameter of the electrodes 33.

In addition, the vibrating plate 3 is configured so that the metal plate 31, the piezoelectric body 32, and the electrodes 33 are positioned so as to overlap at the centers of the main surfaces thereof. Specifically, the vibrating plate 3 is formed so that the piezoelectric body 32 is mounted on the metal plate 31 with the front surface and the rear surface of the piezoelectric body 32 sandwiched between the two electrodes 33. In addition, in this case, an insulating layer, which is not illustrated, is formed over the entire main surface of the metal plate 31 that faces the adjacent electrode 33.

In an exemplary aspect, the metal plate 31 is composed of a material having good electrical conductivity and spring elasticity (for example, a modulus of elasticity of 1 GPa or higher), and specifically, is preferably composed of 42 alloy, stainless steel (SUS), brass, phosphor bronze, or the like. In addition, the thickness of the metal plate 31 is, for example, around 0.08 mm. The material of the metal plate 31 can comprise a material other than a metal, for example, a resin-based material such as a glass epoxy substrate so long as the material has a modulus of elasticity of 1 GPa or higher.

Moreover, the piezoelectric body 32 is composed of a piezoelectric ceramic such as PZT. Furthermore, the thickness of the piezoelectric body 32 is around 0.055 mm, for example. In an exemplary aspect, the thickness of the piezoelectric body 32 can be set to be equal to or more than 20 μm and equal to or less than around several hundred μm, for example, in accordance with the desired characteristics.

Ag baked electrodes with a thickness of around 1 μm or NiCu (nickel-copper alloy) or Ag (silver) sputtering electrodes with a thickness of 1 μm or less are used as the electrodes 33 in an exemplary aspect.

The case 2 is an example of a piezoelectric sound-generating component case and is shaped like a box. Furthermore, the case 2 includes a case body 10 that is for housing the vibrating plate 3 and insert terminals 20 that provided on the case body 10 and are configured for applying a voltage to the vibrating plate 3.

The case body 10 is a box-shaped member. In exemplary aspects, the material of the case body 10 is, for example, a resin, and specifically, a liquid crystal polymer (LCP), syndiotactic polystyrene (SPS), polyphenylene sulfide (PPS), a heat-resistant resin such as epoxy resin, and so on, are desirable.

In addition, the case body 10 includes a bottom part 11 (also referred to as a bottom or base), a side wall part 12 (also referred to as a side wall) that projects from the peripheral edge of the bottom part 11, and an opening 13 that opens on the leading end side of the side wall part 12 in the projection direction of the side wall part 12. The bottom part 11 and the inner peripheral surface of the side wall part 12 form an internal space 14 of the case body 10 in which the vibrating plate 3 is housed. Furthermore, the side wall part 12 has an upper surface 140 on the side near the opening 13. The upper surface 140 is a surface that is adhered to the cover 4 with an adhesive 54, which is described later.

When the case body 10 is seen in plan view in the projection direction, the outer shape of the case body 10, i.e., the shape of the bottom part 11 in plan view is a square shape as shown in FIG. 2, for example. The bottom part 11 has a sound emission hole 111, a support part 112, and a vent 115. In addition, the bottom part 11 (i.e., the base) has first notches 113, second notches 114, and third notches 116, which are configured for attaching the insert terminals 20 described later.

Here, the sound emission hole 111, the first notches 113, the second notches 114, the vent 115, and the third notches 116 are each an example of "an opening" for purposes of this disclosure. In addition, the sound emission hole 111 and the vent 115 penetrate through the bottom part 11 and thereby connect the inside of the case body 10 and the outside to each other. The first notches 113 and the second notches 114 are connected to the third notches 116 and thereby connect the inside of the case body 10 and the outside to each other.

Moreover, the sound emission hole 111 is located on a side of the bottom part 11 near a second side wall 122 of the side wall part 12, which is described later. Sound generated when the vibrating plate 3 undergoes bending vibration is emitted to outside the case body 10 through the sound emission hole 111 as well as through the vent 115.

The support part 112 is formed at the center of the plan view shape of the bottom part 11. The support part 112 supports the vibrating plate 3. Specifically, the support part 112 supports the metal plate 31 of the vibrating plate 3 and thereby supports the entire vibrating plate 3.

The first notches 113 include two sets of notches (i.e., four notches) and the two sets are located in the center parts of two opposing peripheral sides of the bottom part 11. In other words, the first notches 113 of the two sets are respectively located in the bottom part 11 near center parts of a first side wall 121 and a third side wall 123 (e.g., opposite each other), which are described later, of the side wall part 12. These first notches 113 engage with protruding portions of the insert terminals 20 and thereby determine the positions of the insert terminals 20 relative to the case body 10.

Moreover, the second notches 114 include two sets of notches (i.e., four notches) and the sets are located at two opposing corners (corner parts) of the bottom part 11, that is, a corner of the bottom part 11 enclosed by the first side wall 121 and a fourth side wall 124 of the side wall part 12, which are described later, and a corner enclosed by the second side wall 122 and the third side wall 123 of the side wall part 12. These second notches 114 allow the insert terminals 20 to be partially exposed to the internal space 14.

There are two third notches 116 and these third notches 116 are respectively located in end portions of the bottom part 11 that are connected to the first side wall 121 and the third side wall 123, which are described later. In addition, the third notches 116 are continuous with the first notches 113 and the second notches 114. The third notches 116 allow parts of the insert terminals 20, which are described later, to be exposed to the space outside the case 2.

The vent 115 is located at the peripheral edge of the bottom part 11, that is, at the side of the bottom part 11 near the second side wall 122 of the side wall part 12, which is described later. The vent 115 is constructed to reduce air resistance between the case body 10 (case 2) and the mounting substrate when the piezoelectric sound-generating component 1 is mounted on a mounting substrate (not illustrated). Moreover, sound generated when the vibrating plate 3 undergoes bending vibration is emitted to outside the case body 10 through the vent 115 as well as through the sound emission hole 111.

Hereafter, for convenience of description, unless stated otherwise, viewing the case body 10, the side wall part 12 of the case body 10, and so on in plan view along the projection direction is referred to as viewing the case body 10, the side wall part 12, and so on "in plan view". In addition, the shapes of the case body 10, the side wall part 12, and so on that can be seen in this kind of plan view are referred to as the "plan view shapes" of the case body 10, the side wall part 12, and so on.

The side wall part 12 includes the first side wall 121, the second side wall 122, the third side wall 123, and the fourth side wall 124, which project from the sides of the plan view shape of the bottom part 11 as shown in FIG. 6, for example. It is noted that in the following description, the first side wall 121, the second side wall 122, the third side wall 123, and the fourth side wall 124 are collectively referred to as "side walls 120" when there is no need to distinguish between them.

Furthermore, in this embodiment, when the case body 10 is seen in plan view, the side walls 120 have a first thick part 131, a second thick part 132, a third thick part 133, and a fourth thick part 134 at the centers thereof. Note that in the following description, the first thick part 131, the second thick part 132, the third thick part 133, and the fourth thick part 134 are collectively referred to as "thick parts 130" when there is no need to distinguish between them.

The first thick part 131 and the third thick part 133 are examples of "a thick part" possessed by at least some of the side walls 120 of the side wall part 12 located at positions corresponding to the positions where the insert terminals 20 are provided. The second thick part 132 and the fourth thick part 134 are examples of "another thick part" possessed by at least one side wall 120 among two side walls not having a thick part. In addition, the detailed configuration of the thick parts 130 is described later.

The insert terminals 20 are, for example, members having an substantially U-shaped cross-sectional shape formed by bending metal plates (e.g., phosphor bronze or the like) having a thickness of around 0.1 mm. Each insert terminal 20 includes a first piece 21, a second piece 22, and a third piece 23 that connects the first piece 21 and the second piece 22 to each other as shown in FIG. 4, for example.

Furthermore, in this embodiment, two insert terminals 20 are used. The insert terminals 20 are, for example, attached to the case body 10 at opposite (e.g., facing) positions on the case body 10 by the first pieces 21 being embedded in the bottom part 11 of the case body 10. In addition, here, the first pieces 21 and the second pieces 22 are provided so as to sandwich the bottom part 11 therebetween.

Specifically, as illustrated in FIGS. 3, 4, and 6, in a state where the insert terminals 20 are attached to the case body 10, the first pieces 21 are inserted into grooves of the third notches 116 and protruding portions of the first pieces 21 are inserted into the first notches 113. Thus, the positions of the insert terminals 20 relative to the case body 10 are fixed. In addition, the first pieces 21 are partially exposed to the internal space 14 via the second notches 114. Thus, part of each insert terminal 20 is electrically connected to the vibrating plate 3, which is housed in the internal space 14, through an electrically conductive adhesive 52, which is described later. The second pieces 22 and the third pieces 23 are exposed to the space outside the case body 10 via the third notches 116. Thus, a voltage can be applied to the second pieces 22 and the third pieces 23 from outside the case body 10.

The cover 4 is a plate-shaped member and a plan view shape thereof seen when looking at the cover 4 in plan view in the thickness direction is a square shape that is substantially the same as the plan view outer shape of the case 2. In addition, the material of the cover 4 may be, for example, the same as the material of case body 10 in an exemplary aspect.

The adhesive 5 includes an insulating adhesive 51, the electrically conductive adhesive 52, a sealing adhesive 53, and the adhesive 54. Among these adhesives, except for the electrically conductive adhesive 52, the insulating adhesive 51, the sealing adhesive 53, and the adhesive 54 are all insulating adhesives.

The insulating adhesive 51 and the sealing adhesive 53 are adhesives for adhering and fixing the vibrating plate 3 to the case 2. The insulating adhesive 51 is, for example, applied to three places along the circumference of the vibrating plate 3, that is, in the vicinity of the corners of three side walls of the case body 10. The sealing adhesive 53 has elasticity and is applied along the entire peripheral edge of the vibrating plate 3. The electrically conductive adhesive 52 is an adhesive for electrically connecting the electrodes 33 of the vibrating plate 3 and the insert terminals 20 to each other via the second notches 114. In the exemplary aspect, the adhesive 54 is an adhesive for adhering the cover 4 to the upper surface 140 of the case 2.

Thus, in this embodiment, the vibrating plate 3 is fixed to the support part 112 of the bottom part 11 of the case 2 by the insulating adhesive 51, and then the two electrodes 33 provided on the front and rear surfaces of the vibrating plate 3 are respectively electrically connected to the two insert terminals 20, which are exposed from the second notches 114, by the electrically conductive adhesive 52. Then, the gap between the entire peripheral edge of the vibrating plate 3 and the support part 112 is sealed by the elastic sealing adhesive 53. After that, the cover 4 is mounted on the upper surface 140 of the case body 10 using the adhesive 54 and closes the opening 13 of the case 2. Thus, the vibrating plate 3 is housed in the internal space 14 of the enclosure formed by the case 2 and the cover 4 so as to be electrically connected to the insert terminals 20. Furthermore, the thus-formed piezoelectric sound-generating component 1 generates sound as a result of the vibrating plate 3 undergoing bending vibration when a voltage is applied thereto from the insert terminals 20, which are exposed to the space outside the case 2 from the third notches 116. In addition, the generated sound is emitted to outside the case 2 through the sound emission hole 111 and the vent 115.

<Details of Thick Parts 130>

Next, the thick parts 130 of the side wall part 12 of the case 2 will be described in detail while referring to FIGS. 4 to 6.

Before describing the thick parts 130, first, weld lines and the harmful effects of weld lines on a piezoelectric sound-generating component will be described. In the case of injection molding of resin, the further away from the injection gate the resin is (the longer the filling time of the resin), the slower the flow speed of the injected resin becomes and the lower the temperature of the resin becomes. Therefore, the molding state of resin at a position far from the injection gate (position where filling time of resin is long) tends to deteriorate more easily than the molding state of resin at a position close to the injection gate (position where filling time of resin is short).

In addition, when a box-shaped piezoelectric sound-generating component case having insert terminals and an open hole (for example, a sound emission hole) is formed using injection molding of resin, molding tools for forming the insert terminals and the open hole need to be disposed in advance in the mold used to form the case, specifically, along the flow path of the injected resin of the mold. As a result, when the resin is injected and flows into the mold, the resin flow splits upon hitting a molding tool on the flow path of the resin. After that, when the resin flows merge again, both the resin flow speed and the resin temperature have fallen and therefore the resin flows from the different flow branches do not readily mix with each other and cool and harden at the merging point, and a weak point known as a weld line may occur. In addition, when the insert terminals and molding tools are provided at positions inside a side wall part or near a side wall part of the case, the wall thickness of the side wall part becomes thinner and this contributes to the generation of a weld line.

If such a weld line occurs, when the piezoelectric sound-generating component is assembled using the case, the part of the case having the weld line may crack due to stress from the outside. The cracked case will be unable to handle the vibration stress of the vibrating plate as an enclosure. As a result, the vibrational displacement of the vibrating plate will be reduced, the air will not be able to be compressed, and as a result, high sound pressure will not be able to be achieved, and furthermore, variations among the manufactured piezoelectric sound-generating components will occur.

In addition, when the case is cracked, air will enter and exit at the location of the crack. This will cause the peak sound pressure from the intended frequency of the piezoelectric sound-generating component to be shifted with respect to the resonant frequency, which is determined by the volume of the resonance space, i.e., by the internal space of the case, the sound emission holes, and so forth. Consequently, not only is it not possible to realize a high sound pressure with the piezoelectric sound-generating component, but variations also can occur between the manufactured piezoelectric sound-generating components.

However, the resin flow state can be improved by increasing the wall thickness of the side wall part of the case in order to suppress the harmful effects caused by the occurrence of a weld line as described above. Specifically, there is a method in which the wall thickness of the side wall part is increased by increasing the wall thickness on the outer side of the side wall part and there is a method in which the wall thickness of the side wall part is increased by increasing the wall thickness on the inner side (i.e., the resonance space) of the side wall part.

However, if the method in which the wall thickness is increased on the outer side of the side wall part is adopted, the piezoelectric sound-generating component is increased in size, and when the piezoelectric sound-generating component comes to be mounted on a product, it may be necessary to adjust the mounting position with respect to other components and the design of the product may need to be significantly changed. In addition, if the method in which the wall thickness is increased on the inner side of the side wall part is adopted, the resonance space will become smaller and it may no longer be possible to realize a high sound pressure due to the decreased resonance space.

In response to these problems, the exemplary embodiment provides the case 2 for a piezoelectric sound-generating component and the piezoelectric sound-generating component 1 that can realize a decrease in the size of the piezoelectric sound-generating component 1 and secure the size of the resonance space (i.e., the internal space 14) by using the thick parts 130 having a simple configuration, and can also obtain high reliability by realizing an improvement in strength.

Referring back to the description of the thick parts 130, it is noted that four thick parts 130 are provided in the exemplary embodiment. Each thick part 130 is a part located at the center of the respective side wall 120. In other words, each side wall 120 has a thick part 130. Specifically, as illustrated in FIG. 6, regarding the first side wall 121 and the third side wall 123, which are on the sides where the insert terminals 20 are provided, the first side wall 121 has the first thick part 131 at the center thereof in the longitudinal direction of the plan view shape and the third side wall 123 has the third thick part 133 at the center thereof in the longitudinal direction of the plan view shape. In addition, regarding the second side wall 122 and the fourth side wall 124, which are on the sides where the insert terminals 20 are not provided, the second side wall 122 has the second thick part 132 at the center thereof in the longitudinal direction of the plan view shape and the fourth side wall 124 has the fourth thick part 134 at the center thereof in the longitudinal direction of the plan view shape.

Furthermore, the first to fourth thick parts 131 to 134 have the same shape in the exemplary aspect. Hereafter, the first to fourth thick parts 131 to 134 will be described as "thick parts 130" without distinguishing between them.

The thick parts 130 each have a rectangular plan view shape. Furthermore, when the case body 10 is seen in plan view, in each side wall 120, the transverse direction width of the thick part 130 is greater than the transverse direction width of the parts of the side wall 120 that are adjacent to the thick part 130, in other words, the transverse direction width of any of the side walls 120 in the vicinity of the corners of the four side walls 120. In other words, when the case body 10 is seen in plan view, each side wall 120 has the respective thick part 130, which is at the center and has a large transverse direction width (e.g., a wall thickness), and thin parts 150, which are located at both sides of the thick part 130 and have a small transverse direction width (e.g., a wall thickness).

Furthermore, when the case body 10 is seen in plan view, each thick part 130 is formed so as to protrude more greatly towards the center of the internal space 14 than the thin parts 150, which are closer to the corners. Thus, corner parts of the internal space 14 that are near the corners of the four side walls 120 and surrounded by the thin parts 150 are wider than central parts of the internal space 14 that are at the centers of the four thick parts 130.

In addition, as illustrated in FIG. 4, when the thick parts 130 are seen in plan view along the longitudinal direction of the thick parts 130, the thick parts 130 each have a substantially trapezoidal plan view shape. Specifically, as illustrated in FIGS. 4 and 5, the transverse direction width of each thick part 130 increases from the leading end side of the side wall 120 to the bottom part 11. In other words, the surfaces of the thick parts 130 that face the internal space 14 are inclined with respect to the outer peripheral surfaces of the respective side walls 120.

Next, the effects of the thick parts 130 of the case 2 (case body 10) according to the exemplary embodiment will be described in comparison to a case 2000 (case body 1000) according to a comparative example while referring to FIGS. 5 to 10B.

Figure 7:
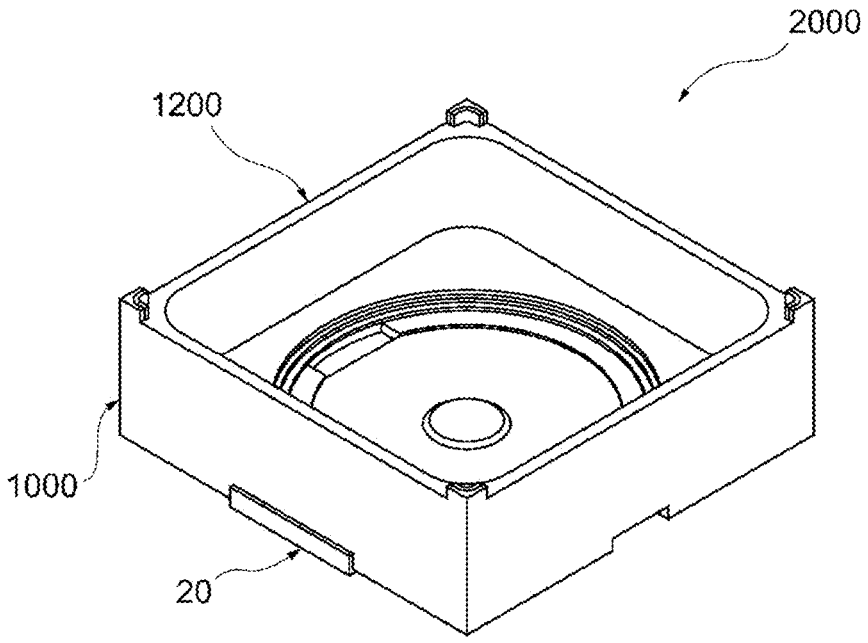
FIG. 7 is a perspective view for describing the configuration of a piezoelectric sound-generating component case according to a comparative example.
Figure 8A:
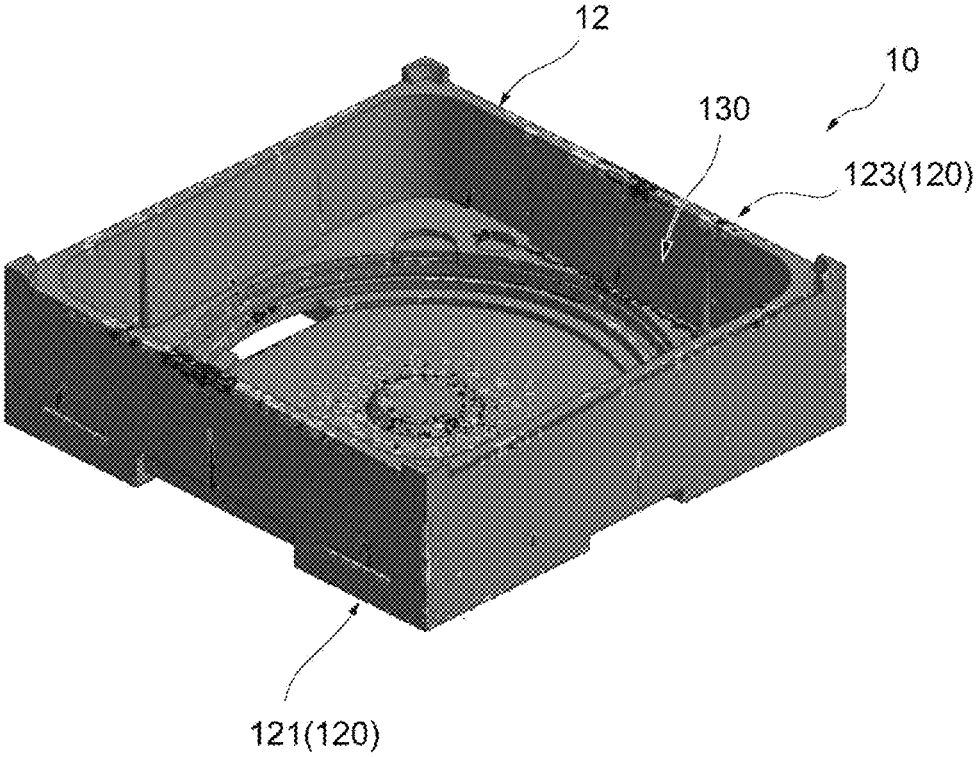
FIG. 8A is a diagram illustrating the state of resin flow in injection molding of a piezoelectric sound-generating component case body according to the exemplary embodiment.
Figure 8B:
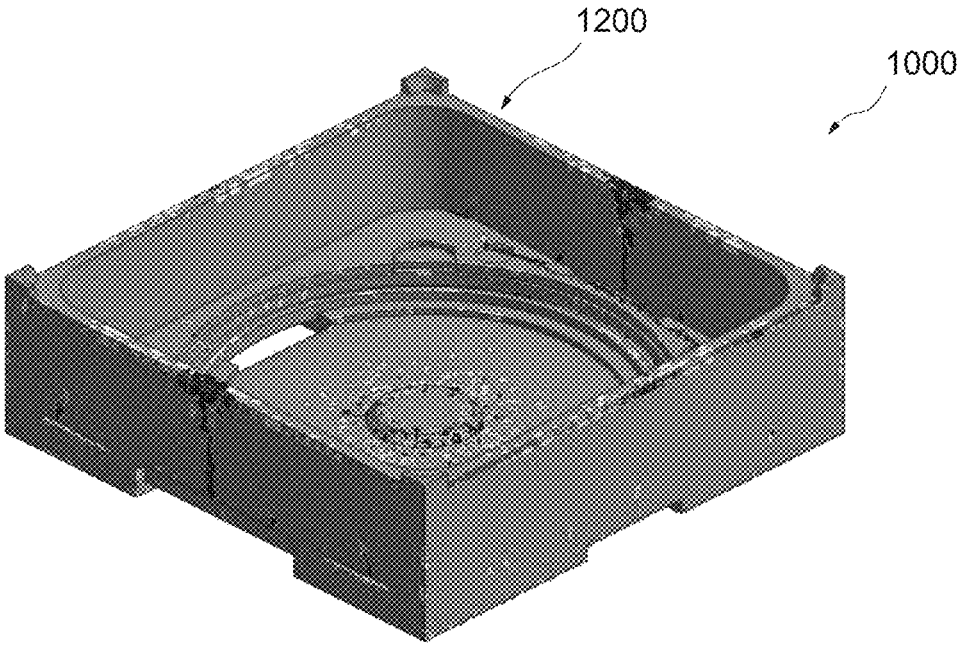
FIG. 8B is a diagram for describing the state of resin flow in injection molding of a piezoelectric sound-generating component case body according to the comparative example.
Figure 9A:
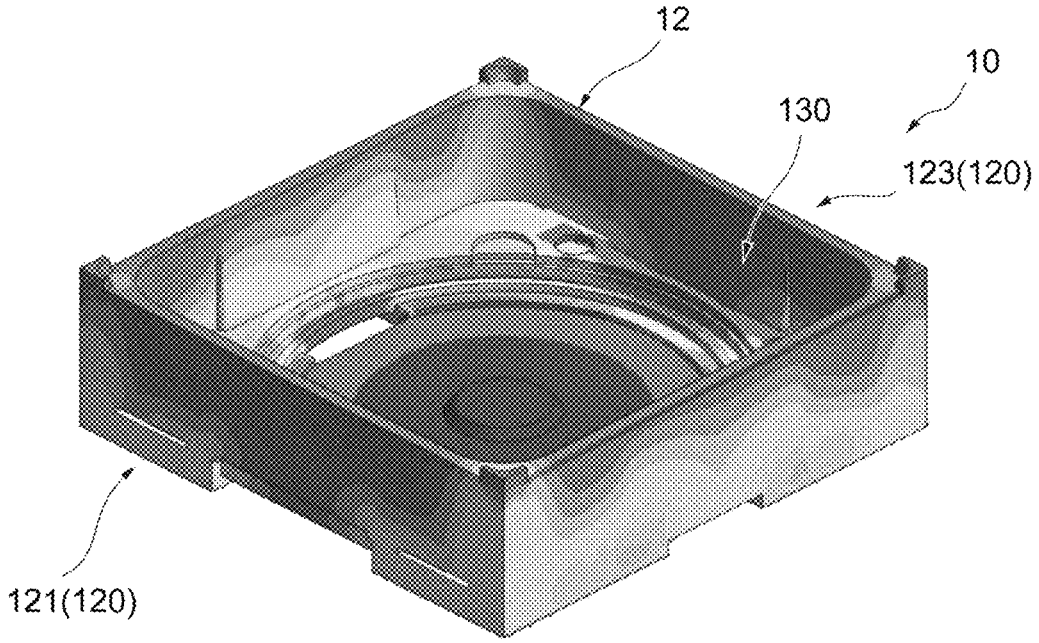
FIG. 9A is a diagram illustrating the filling time of resin in injection molding of the piezoelectric sound-generating component case body according to the exemplary embodiment.
Figure 9B:
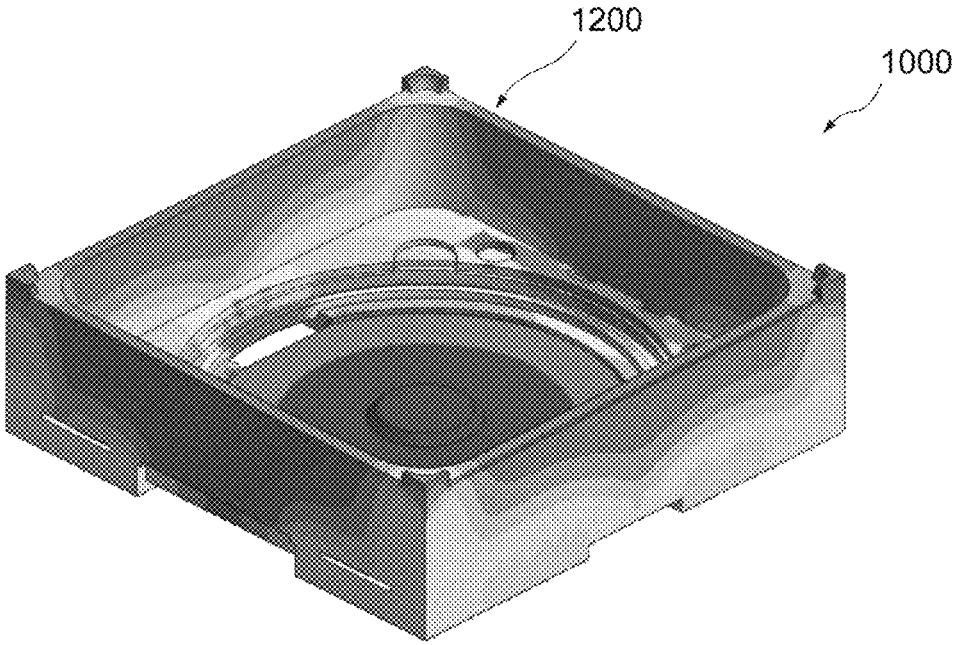
FIG. 9B is a diagram for describing the filling time of resin in injection molding of the piezoelectric sound-generating component case body according to the comparative example.
Figure 10B:
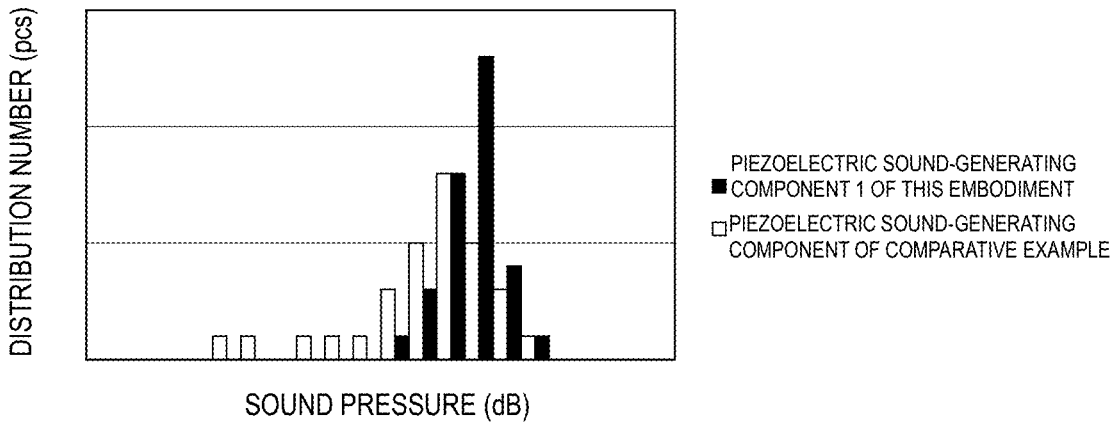
FIG. 10B is a diagram for describing the sound pressure distributions of the piezoelectric sound-generating component according to the exemplary embodiment and the piezoelectric sound-generating component according to the comparative example.

FIG. 7 is a perspective view for describing the configuration of the piezoelectric sound-generating component case 2000 according to the comparative example. FIG. 8A is a diagram illustrating the state of resin flow in injection molding of the piezoelectric sound-generating component case body 10 according to the embodiment. FIG. 8B is a diagram for describing the state of resin flow in injection molding of the piezoelectric sound-generating component case body 1000 according to the comparative example. FIG. 9A is a diagram illustrating the filling time of resin in injection molding of the piezoelectric sound-generating component case body 10 according to the embodiment. FIG. 9B is a diagram for describing the filling time of resin in injection molding of the piezoelectric sound-generating component case body 1000 according to the comparative example. FIG. 10A is a table comparing the sound pressure distributions of the piezoelectric sound-generating component 1 according to the exemplary embodiment described above and the piezoelectric sound-generating component according to the comparative example. FIG. 10B is a diagram for describing the sound pressure distributions of the piezoelectric sound-generating component 1 according to the exemplary embodiment and the piezoelectric sound-generating component according to the comparative example.

Here, the configuration of the piezoelectric sound-generating component case 2000 according to the comparative example will be simply described. As illustrated in FIG. 7, the case 2000 according to the comparative example includes the case body 1000 and insert terminals 20. Furthermore, the case body 1000 and the case body 10 according to this embodiment differ in terms of a side wall part 1200 of the case body 1000 according to the comparative example. Specifically, the side wall part 1200 according to the comparative example does not include a configuration corresponding to the thick parts 130 of the side wall part 12 according to the embodiment.

Hereafter, the differences between the characteristics of the case 2000 (case body 1000) and the case 2 (case body 10 in the exemplary embodiment) with and without the thick parts 130 will be described while comparing the case 2000 (case body 1000) according to the comparative example and the case 2 (case body 10) according to the embodiment.

First, the differences between the resin flow states in injection molding of the case body 10 and the case body 1000 with and without the thick parts 130 will be described while referring to FIGS. 8A and 8B. In addition, in FIGS. 8A and 8B, the darker the illustrated color, the worse the resin flow state. The locations having the darkest colors are the locations where weld lines are generated.

As illustrated in FIG. 8A, in the case body 10 according to the embodiment employing the thick parts 130, only slightly darker colored areas can be seen in the centers of the first side wall 121 and the third side wall 123 of the side wall part 12, which are on the sides where the insert terminals 20 (refer to FIG. 6) are provided, and no weld lines that penetrate in the direction in which the side wall 120 projects were formed.

In contrast, as illustrated in FIG. 8B, in the case body 1000 according to the comparative example that does not employ the thick parts 130, long thick weld lines that penetrate in the projection direction of the side wall part 1200 are formed in the centers of side walls of the side wall part 1200 on the sides where the insert terminals 20 (refer to FIG. 7) are provided.

Thus, with the thick parts 130, the resin flow state in injection molding of the side walls 120 of the case body 10 can be improved and the occurrence of weld lines can be reduced. In addition, the thick parts 130 according to the embodiment protrude toward the center of the internal space 14 of the side wall part 12 and are provided on parts of the side wall part 12 where weld lines are likely to occur. Therefore, the problem of the case body 10 and the piezoelectric sound-generating component 1 being increased in size as a result of being provided with the thick parts 130 and the problem of the resonance space becoming smaller due to a reduction in the volume of the internal space 14 can be suppressed. Therefore, in addition to providing a reduction in size for the piezoelectric sound-generating component 1 employing the case body 10, the size of the resonance space (i.e., internal space 14) inside the case body 10 can be maintained and an improvement in the strength of the case body 10 can be realized.

Next, the differences between resin filling times in injection molding of the case body 10 and the case body 1000 with and without the thick parts 130 will be described while referring to FIGS. 9A and 9B. In addition, in FIGS. 9A and 9B, the darker the illustrated color, the longer the resin filling time. The locations illustrated with the darkest colors indicate the places where the resin filling time is longest and where the resin molding state (e.g., resin flow speed, resin temperature, and so on) is worst.

As illustrated in FIGS. 9A and 9B, the areas illustrated with the darkest colors in the first side wall 121 and the third side wall 123 of the side wall part 12, which are on the sides where the insert terminals 20 (refer to FIG. 6) are provided, of the case body 10 according to the exemplary embodiment employing the thick parts 130 are significantly smaller than the areas illustrated with the darkest colors in the side wall part 1200 on the sides where the insert terminals 20 are provided (refer to FIG. 7) in the case body 1000 according to comparative example not employing the thick parts 130.

Therefore, with the thick parts 130, the resin filling time in injection molding of the side walls 120 of the case body 10 can be shortened and the molding state of the resin can be improved. In addition, as described using FIG. 8A, the problem of the case body 10 and the piezoelectric sound-generating component 1 being increased in size as a result of employing the thick parts 130 and the problem of the resonance space becoming smaller due to a reduction in the volume of the internal space 14 can be suppressed. Therefore, in addition to providing a reduction in size for the piezoelectric sound-generating component 1 employing the case body 10 (case 2), the size of the resonance space (internal space 14) inside the case body 10 (case 2) can be maintained and an improvement in the strength of the case body 10 (case 2) can be realized.

In addition, the differences between the sound pressure distributions of the case body 10 and the case 2000 with and without the thick parts 130 will be described while comparing the sound pressure distributions of the piezoelectric sound-generating component 1 according to the embodiment and the piezoelectric sound-generating component according to the comparative example with reference to FIGS. 10A and 10B. In FIGS. 10A and 10B, sound pressure distribution measurement results for 30 piezoelectric sound-generating components 1 according to the embodiment and 30 piezoelectric sound-generating components according to the comparative example are illustrated.

As illustrated in FIG. 10A, for the piezoelectric sound-generating component 1 according to the exemplary embodiment employing the thick parts 130, the sound pressure reached a high sound pressure of 76.0 dB or higher in 29 of the piezoelectric sound-generating components 1. Furthermore, the range of the sound pressure distribution of these 30 piezoelectric sound-generating components 1 is from 75.5 dB to 78.0 dB.

In contrast, as illustrated in FIG. 10B, for the piezoelectric sound-generating component according to the comparative example not employing the thick parts 130, the sound pressure reached a high sound pressure of 76.0 dB or higher in 17 of the piezoelectric sound-generating components. Furthermore, the range of the sound pressure distribution of these 30 piezoelectric sound-generating components is from 72.0 dB to 77.5 dB.

Thus, the number of products that reached a high sound pressure in the case of the piezoelectric sound-generating component 1 according to the exemplary embodiment having the thick parts 130 as described above increased to around 1.7 times that in the case of the piezoelectric sound-generating component according to the comparative example that does not employ the thick parts 130, and almost all of the piezoelectric sound-generating components 1 achieved a high sound pressure. In addition, the range over which the sound pressure is distributed is narrower and variations in sound pressure are fewer for the piezoelectric sound-generating component 1 according to the embodiment that employs the thick parts 130 than for the piezoelectric sound-generating component according to the comparative example that does not employ the thick parts 130. Therefore, the piezoelectric sound-generating component 1 having the case body 10 with the thick parts 130 generates a high sound pressure and variations in the sound pressure distribution are suppressed. Therefore, the highly reliable piezoelectric sound-generating component 1 is obtained.

<Modifications of Thick Parts 130>

It is noted that the present invention is not limited to the above-described embodiment and the thick parts can be modified in terms of their configuration and used in various ways. FIGS. 11A to 11D are diagrams for describing thick parts 130 of a piezoelectric sound-generating component case according to additional exemplary embodiments. Hereafter, the configurations of thick parts 130 according to the additional exemplary embodiments of the present invention will be described while referring to FIGS. 11A to 11D. In the following description of the thick parts 130 according to these embodiments, descriptions of the parts of the configurations that are the same as in the above-described embodiment are omitted and only the parts of the configurations that are different are described. FIGS. 11A to 11D are diagrams in which the case is seen in plan view and the case part is shaded with hatching.

Figure 11A:
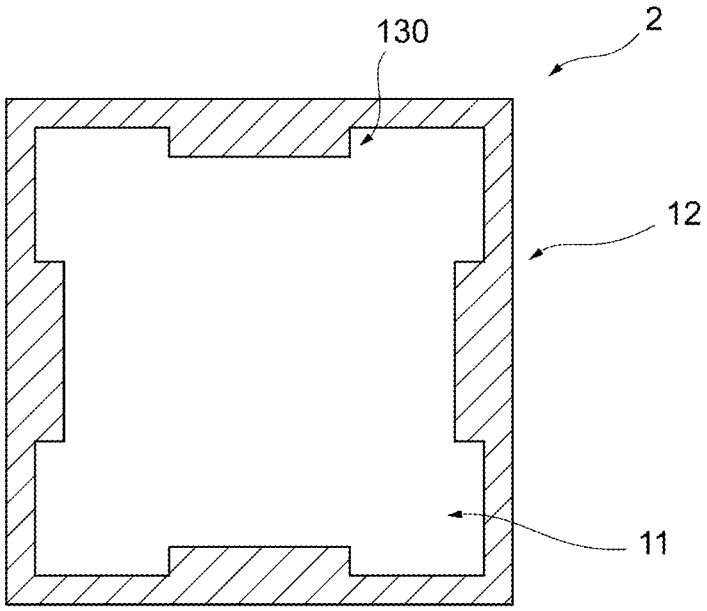
FIG. 11A is a diagram for describing the configuration of an example of a thick part of a piezoelectric sound-generating component case according to another exemplary embodiment.

In the above description, the transverse direction width of the plan view shape of the thick parts 130 was described as increasing from the leading end side of the side wall part 12 to the bottom part 11, but the present invention is not limited to this configuration. For example, as illustrated in FIG. 11A, the transverse direction width of the plan view shape of the thick parts 130 may be uniform from the leading end side of the side wall part 12 to the bottom part 11. Furthermore, for example, the transverse direction width of the plan view shape of the thick parts 130 may change in a non-continuous manner from the leading end side of the side wall part 12 to the bottom part 11.

In the above description, it was described that the surfaces of the thick parts 130 that face the internal space 14 are inclined flat surfaces, but it is noted that the exemplary aspects of the present invention are not limited to this configuration. For example, the surfaces of the thick parts 130 that face the internal space 14 may be curved surfaces that change in a continuous manner or may be surfaces consisting of flat surfaces and curved surfaces.

Figure 11B:
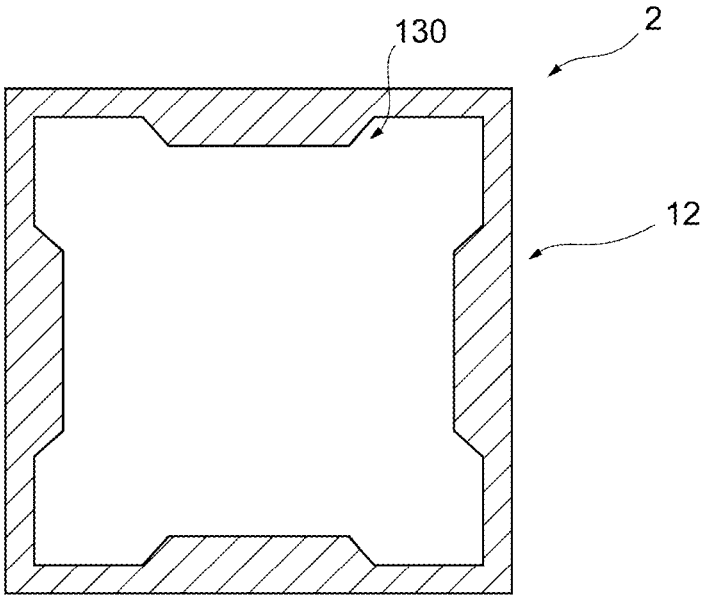
FIG. 11B is a diagram for describing the configuration of an example of a thick part of a piezoelectric sound-generating component case according to another exemplary embodiment.

In the above description, the plan view shape of the thick parts 130 was described as being a rectangular shape, but the present invention is not limited to this configuration. For example, as illustrated in FIG. 11B, the plan view shape of the thick parts 130 can be a shape having inclined surfaces at both ends, i.e., can be a trapezoidal shape. In addition to the example illustrated in FIG. 11B, for example, in the plan view shape of thick parts 130, the thick parts 130 can have a chamfered or R shape at both ends. In addition, for example, the plan view shape of the thick parts 130 can be other shapes such as a parallelogram, a semicircle, and so on.

Figure 11C:
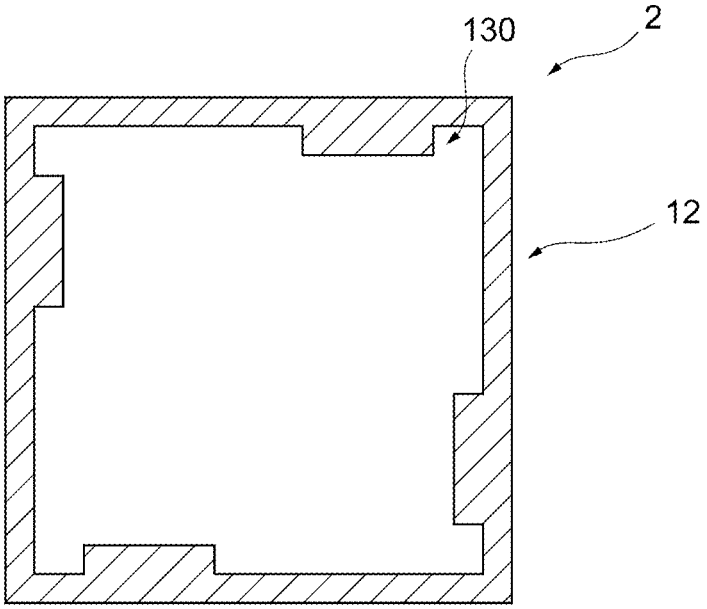
FIG. 11C is a diagram for describing the configuration of an example of a thick part of a piezoelectric sound-generating component case according to another exemplary embodiment.

In the above description, the thick parts 130 were described as being disposed in regions containing the centers of the side walls 120, but it is noted that the exemplary aspects of the present invention are not limited to this configuration. For example, the thick parts 130 may be disposed in regions not containing the centers of the side walls 120. Specifically, for example, as illustrated in FIG. 11C, the thick parts 130 may be formed between the centers and the end portions of the side walls 120. In addition, as described above, it is preferable that the parts of the internal space 14 near the corners of the four side walls 120 of the case 2 be formed so as to be wider than the other parts of the internal space 14 to facilitate application of the insulating adhesive 51, which is for adhering the vibrating plate 3 to the case 2. Therefore, it is preferable that each thick part 130 be formed on part of the respective side wall 120 other than the two ends of the respective side wall 120.

Figure 11D:
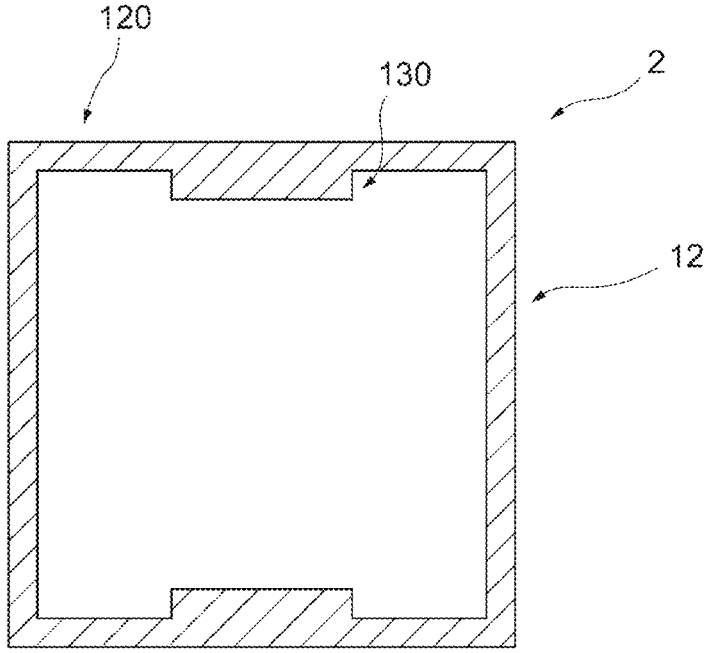
FIG. 11D is a diagram for describing the configuration of an example of a thick part of a piezoelectric sound-generating component case according to another exemplary embodiment.

In the above description, the four thick parts 130 (i.e., first to fourth thick parts 131 to 134) were described as being respectively provided on the four side walls 120 (i.e., first to fourth side walls 121 to 124), but it is noted that the present invention is not limited to this configuration. For example, as illustrated in FIG. 11D, the thick parts 130 do not have to be provided on all of the side walls 120 and may instead be provided on the two side walls 120 on the sides where the insert terminals 20 (refer to FIG. 6) are provided and where weld lines are most likely to occur.

An exemplary embodiment of the present invention has been described above.

The piezoelectric sound-generating component case 2 according to the exemplary embodiment includes the case body 10 for housing the vibrating plate 3 that vibrates when a voltage is applied thereto and the insert terminals 20 that are provided in the case body 10 and are for applying the voltage to the vibrating plate 3. The case body 10 includes the bottom part 11 and the side wall part 12 that projects from the peripheral edge of the bottom part 11. The case body 10 is provided with the opening 13 that opens on the leading end side, in the projection direction, of the side wall part 12. The side wall part 12 has the thick parts 130 at least on the sides where the insert terminals 20 are provided. When the case body 10 is seen in plan view, the transverse direction width of the thick parts 130 of the side wall part 12 is larger than the transverse direction width of the parts of the side wall part 12 that are adjacent to the thick parts 130.

With this configuration, it is possible to realize size reduction and secure the size of the resonance space, and in addition high reliability can be obtained by realizing an improvement in strength.

Furthermore, in this configuration, the material of the case body 10 may be a resin, for example. With this configuration, the case body 10 can be simply formed using injection molding.

In addition, in the above-described configuration, the transverse direction width of the thick parts 130 may be uniform from the leading end side of the side wall part 12 to the bottom part 11. With this configuration, by reliably reducing the occurrence of weld lines, the strength of the case is improved and a piezoelectric sound-generating component case with a reduction in size and high reliability is obtained.

In addition, in the above-described configuration, the transverse direction width of the thick parts 130 may increase from the leading end side of the side wall part 12 to the bottom part 11. With this configuration, the occurrence of weld lines is reduced and the strength of the case is improved, and additionally the size of the resonance space can be maintained, and a piezoelectric sound-generating component case that realizes a reduction in size and has high reliability can be obtained.

In addition, in the above-described configuration, when the case body 10 is seen in plan view, the bottom part 11 may have a rectangular shape or a square shape, the side wall part 12 may include the four side walls 120 that project from the edges of the bottom part 11, and at least one of the side walls 120 out of the four side walls 120 may have the thick part 130. With this configuration, by reducing the occurrence of weld lines, the strength of the case is improved and a piezoelectric sound-generating component case that realizes a reduction in size and has high reliability is obtained.

In addition, in the above-described configuration, out of the four side walls 120, two side walls 120 that face each other or two side walls 120 that are adjacent to each other may have the thick parts 130. With this configuration, the occurrence of weld lines can be reduced and the size of the resonance space can be maintained by providing the thick parts at locations where weld lines are likely to occur.

In addition, the bottom part 11 of the case body 10 may have an open hole that connects the space outside the case body 10 and the internal space 14 to each other. The open hole may be provided in the bottom part 11 in the vicinity of at least one side wall 120 out of two side walls 120 that do not have the thick parts 130 among the four side walls 120, or at a position where the at least one side wall 120 and the bottom part 11 are connected to each other. The at least one side wall 120 may have another thick part 130 where an insert terminal 20 is not provided. With this configuration, the occurrence of weld lines caused by insert terminals and the occurrence of weld lines caused by the open hole can be reduced and the strength of the case can be improved.

Furthermore, in the above-described configuration, when the case body 10 is seen in plan view, each thick part 130 may be disposed in a region containing the center of any of the side walls 120. With this configuration, by reducing the occurrence of weld lines in regions containing the centers of the side walls of the case, the strength of the case is improved and a piezoelectric sound-generating component case with a reduction in size and high reliability is obtained.

Furthermore, in the above-described configuration, when the case body 10 is seen in plan view, each thick part 130 may be disposed in a region not containing the center of any of the side walls 120. With this configuration, by reducing the occurrence of weld lines in regions not containing the centers of the side walls of the case, the strength of the case is improved and a piezoelectric sound-generating component case with a reduction in size and high reliability is obtained.

Furthermore, in the above-described configuration, when the case body 10 is seen in plan view, the transverse direction width of each thick part 130 may be larger than the transverse direction width of any of the side walls in the vicinity of the corners of the four side walls. With this configuration, in addition to reducing the occurrence of weld lines, an improvement in work efficiency is realized by securing spaces in which to apply an adhesive.

The piezoelectric sound-generating component 1 according to the exemplary embodiment of the present invention includes the piezoelectric sound-generating component case 2 having any of the above-described configurations, the vibrating plate 3, and the cover 4 that houses, together with the case 2, the vibrating plate 3. With this configuration, it is possible to realize size reduction and secure the size of the resonance space, and in addition high reliability can be obtained by realizing an improvement in strength.

[Additional Modifications]

It is noted that the present invention is not limited to the above-described embodiments and can be modified and used in various ways. Hereafter, additional modifications of the present invention will be described.

In the above-described embodiment, the metal plate 31, the piezoelectric body 32, and the electrodes 33 forming the vibrating plate 3 were described as being shaped like circular plates, but the present invention is not limited to this configuration. For example, the metal plate 31, the piezoelectric body 32, and the electrodes 33 may instead each have a rectangular shape or a polygonal shape. In addition, for example, at least part of each of the metal plate 31, the piezoelectric body 32, and the electrodes 33 may have a circular shape and the remaining part may have a rectangular or polygonal shape.

In the above-described embodiment, two insert terminals 20 are provided on opposite sides of the side wall part 12, i.e., on two side walls 120 that face each other, but the present invention is not limited to this configuration. For example, two insert terminals 20 can be provided on two adjacent side walls 120 of the side wall part 12. Furthermore, for example, two insert terminals 20 may be provided on a single side wall 120.

In the above-described embodiment, the insert terminals 20 are U shaped, but the present invention is not limited to this configuration. For example, the insert terminals 20 may have another shape such as an L shape.

In the above-described embodiment, the plan view shape of the case 2 was described as being a square shape, but the present invention is not limited to this configuration. For example, the plan view shape of the case 2 can be a rectangular shape, a circular shape, or another polygonal shape.

In the above-described embodiment, the plan view shape of the case 2 seen when looking in plan view at the case 2 in the projection direction was a square shape, but the present invention is not limited to this configuration. For example, the plan view shape of the case 2 can be a rectangular shape, a circular shape, or another polygonal shape.

In the above-described embodiment, the material of the case body 10 was a resin, but the present invention is not limited to this material. For example, the material of the case body 10 can be insulating material, such as a ceramic.

In the above-described embodiment, the cover 4 was described as being a flat plate, but the present invention is not limited to this configuration. For example, the cover 4 can be a box-shaped member. Furthermore, in the above-described embodiment, the cover 4 was described as being formed of the same material as the case 2, but the present invention is not limited to this configuration and the cover 4 can be formed of a different material from the case 2.

In general, it is noted that the embodiments described above are provided for easy understanding of the embodiments of the present invention and the embodiments are not to be interpreted as limiting the present invention. The present invention can be modified or improved without departing from the gist of the invention and equivalents to the present invention are also included in the present invention. In other words, appropriate design changes made to the embodiments by one skilled in the art are included in the scope of the present invention so long as the changes have the characteristics of the present invention. For example, the elements included in the embodiments and the arrangements, materials, conditions, shapes, sizes and so forth of the elements are not limited to those exemplified in the embodiments and can be changed as appropriate. In addition, each embodiment is merely an illustrative example and it goes without saying that parts of the configurations illustrated in different embodiments can be substituted for each other or combined with each other and these new configurations are also included in the scope of the present invention so long as the configurations have the characteristics of the present invention.

REFERENCE SIGNS LIST

1 piezoelectric sound-generating component,
2 case,
3 vibrating plate,
4 cover,
5 adhesive,
10 case body,
11 bottom part,
12 side wall part,
13 opening,
14 internal space,
20 insert terminal,
21 first piece,
22 second piece,
23 third piece,
111 sound emission hole,
120 side wall,
121 first side wall,
122 second side wall,
123 third side wall,
124 fourth side wall,
130 thick part,
131 first thick part,
132 second thick part,
133 third thick part,
134 fourth thick part

The invention claimed is:

1. A piezoelectric sound-generating component case comprising:

a case body housing a vibrating plate that is configured to vibrate when a voltage is applied thereto with the case body including:

a base, a side wall that projects from a peripheral edge of the base, and an opening on a leading end side of the side wall in a projection direction of the side wall; and an insert terminal disposed on or in the case body and configured to apply the voltage to the vibrating plate, wherein the side wall includes a thick part on at least a side where the insert terminal is disposed, and wherein, in a plan view of the case body, a width in a transverse direction of the thick part of the side wall is larger than a width in the transverse direction of a part of the side wall adjacent to the thick part.

2. The piezoelectric sound-generating component case according to claim 1, wherein the case body comprises a resin.

3. The piezoelectric sound-generating component case according to claim 1, wherein the width of the thick part is uniform from the leading end side of the side wall to the base.

4. The piezoelectric sound-generating component case according to claim 1, wherein the width of the thick part increases from the leading end side of the side wall to the base.

5. The piezoelectric sound-generating component case according to claim 1, wherein, in a plan view of the case body, the base has a rectangular shape or a square shape, and the side wall includes four side walls that project from respective edges of the base, with at least one of the four side walls having the thick part.

6. The piezoelectric sound-generating component case according to claim 5, wherein two opposite side walls or two adjacent side walls out of the four side walls each have the thick part.

7. The piezoelectric sound-generating component case according to claim 6, wherein the base of the case body has an open hole that connects a space outside the case body to an internal space of the case body.

8. The piezoelectric sound-generating component case according to claim 7, wherein the open hole is disposed in the base adjacent to at least one side wall of two side walls that do not have the thick part among the four side walls, or is disposed at a position where the at least one side wall is connected to the base, with the at least one side wall having the thick part.

9. The piezoelectric sound-generating component case according to claim 8, wherein, in the plan view of the case body, the thick part is disposed in a region containing a center of the respective side walls having the thick part.

10. The piezoelectric sound-generating component case according to claim 8, wherein, in a plan view of the case body, the thick part is disposed in a region not containing a center of the respective side walls having the thick part.

11. The piezoelectric sound-generating component case according to claim 8, wherein, in a plan view of the case body, the width in the transverse direction of the thick part is larger than the width in the transverse direction of any of the side walls near corners of the four side walls.

12. The piezoelectric sound-generating component case according to claim 1, wherein the base includes at least one notch constructed to receive the insert terminal.

13. The piezoelectric sound-generating component case according to claim 12, wherein the insert terminal includes a first piece inserted into a groove of the at least one notch and that is at least partially exposed in an internal space of the case body and is electrically connected to the vibrating plate.

14. The piezoelectric sound-generating component case according to claim 13, wherein the insert terminal further includes a second piece coupled to the first piece and that is exposed to a space outside the case body for receiving the voltage to be applied to the vibrating plate.

15. The piezoelectric sound-generating component case according to claim 1, wherein a surface of the thick part of the side wall that faces an internal space of the case body is inclined with respect to outer peripheral surfaces of the side walls.

16. A piezoelectric sound-generating component comprising:

the piezoelectric sound-generating component case according to claim 1;

the vibrating plate; and a cover that houses the vibrating plate with the piezoelectric sound-generating component case.

17. A piezoelectric sound-generating component case comprising:

a case body having a base and at least one side wall that extends from a periphery of the base to define an internal space for housing a vibrating plate, with the case body including an opening on a leading end side of the at least one side wall in a projection direction of the at least one side wall; and an insert terminal disposed on or in the case body, wherein the at least one side wall includes a thick part being on a side of the at least one side wall where the insert terminal is disposed, and wherein, in a plan view of the case body, the thick part has a width in a transverse direction thereof that is larger than a width in the transverse direction of a part of the side wall adjacent to the thick part.

18. The piezoelectric sound-generating component case according to claim 17, wherein the width of the thick part is uniform from the leading end side of the side wall to the base.

19. The piezoelectric sound-generating component case according to claim 17, wherein the width of the thick part increases from the leading end side of the side wall to the base.

* * * * *